US007223096B2

(12) United States Patent
Wong

(10) Patent No.: US 7,223,096 B2
(45) Date of Patent: May 29, 2007

(54) LIGHTER

(76) Inventor: Chi Lam Wong, 1617 Euclid Ave., San Gabriel, CA (US) 91776

( * ) Notice: Subject to any disclaimer, the term of this patent is extended or adjusted under 35 U.S.C. 154(b) by 0 days.

(21) Appl. No.: 10/724,307

(22) Filed: Nov. 28, 2003

(65) Prior Publication Data

US 2005/0118545 A1 Jun. 2, 2005

(51) Int. Cl.
*F23Q 2/36* (2006.01)
*F23Q 2/34* (2006.01)

(52) U.S. Cl. ..... 431/152; 431/142; D27/157; 16/379; 16/380; 220/845

(58) Field of Classification Search ..... 431/129–142, 431/152, 143; 220/845, 848, 829; 16/380, 16/379, 254, 382, 263, 270, 272; D27/157, D27/159
See application file for complete search history.

(56) References Cited

U.S. PATENT DOCUMENTS

| | | | | | |
|---|---|---|---|---|---|
| 418,540 | A | * | 12/1889 | Starr | 16/379 |
| 905,834 | A | * | 12/1908 | Blackwell | 16/382 |
| 1,078,237 | A | * | 11/1913 | Baldwin | 16/379 |
| 1,484,009 | A | * | 2/1924 | Corning | 16/270 |
| 1,502,431 | A | * | 7/1924 | Hubbard | 16/262 |
| 1,505,029 | A | * | 8/1924 | Kellerman | 16/270 |
| 1,681,032 | A | * | 8/1928 | Fuller | 220/845 |
| 2,023,978 | A | * | 12/1935 | Shields | 220/829 |
| 2,126,049 | A | * | 8/1938 | Shiffman et al. | 220/829 |
| 2,126,050 | A | * | 8/1938 | Shiffman et al. | 220/845 |
| 2,231,909 | A | * | 2/1941 | Hempel | 16/296 |
| 2,541,377 | A | * | 2/1951 | Neely | 16/293 |
| 2,583,350 | A | * | 1/1952 | Witzgall | 220/829 |
| 2,670,872 | A | * | 3/1954 | Olesky | 220/845 |
| 2,682,969 | A | * | 7/1954 | Sunko | 220/843 |
| 2,839,778 | A | * | 6/1958 | Hutchinson et al. | 16/245 |
| 2,939,169 | A | * | 6/1960 | Anderson | 16/384 |
| 3,300,809 | A | * | 1/1967 | Neerman et al. | 16/270 |
| 3,394,835 | A | * | 7/1968 | Peterson | 220/833 |
| 3,615,035 | A | * | 10/1971 | Newton | 220/847 |
| 3,977,043 | A | * | 8/1976 | Zernig | 16/270 |
| 4,325,492 | A | * | 4/1982 | Kunze | 220/831 |

(Continued)

FOREIGN PATENT DOCUMENTS

JP 11-241822 * 9/1999

(Continued)

*Primary Examiner*—Carl D. Price
(74) *Attorney, Agent, or Firm*—Raymond Y. Chan; David and Raymond Patent Group

(57) ABSTRACT

A lighter comprises a lighter housing, a gas container for storing liquid inflammable gas, a combustion device connected to the gas container, and an igniter for igniting inflammable gas in the combustion device. The housing includes an upper cover and a case, wherein one side of the upper cover includes a protuberance forming a small hole thereon; a connector disposed below the protuberance of the upper cover for connecting the upper cover and the case, wherein the connector includes a recess portion coupling with the protuberance and having transverse holes on both sides of the recess portion; and a bolt for rotationally connecting the protuberance and the recess portion; wherein the case has at its edge port a longitudinal groove connected to the connector and having an opening at the edge port of the groove to couple with the protuberance of the upper cover.

9 Claims, 3 Drawing Sheets

U.S. PATENT DOCUMENTS

| | | | | | |
|---|---|---|---|---|---|
| 4,397,064 | A | * | 8/1983 | Lautenschlager et al. | 16/379 |
| 4,424,606 | A | * | 1/1984 | Sorimachi | 16/223 |
| 5,208,943 | A | * | 5/1993 | Dubach et al. | 16/258 |
| 5,261,552 | A | * | 11/1993 | L'Hotel et al. | 220/836 |
| 6,530,498 | B1 | * | 3/2003 | Ovadia | 220/829 |

FOREIGN PATENT DOCUMENTS

| | | | |
|---|---|---|---|
| JP | 2001-165437 | * | 6/2001 |
| WO | WO 96/28695 | * | 9/1996 |

* cited by examiner

LIGHTER

FIELD OF THE INVENTION

The present invention relates to a lighter, and in particular, to a lighter with an upper cover.

BACKGROUND OF THE INVENTION

Currently, lighters with upper covers on market have their upper covers connected to brackets of combustion devices, which disadvantageously make the structures complicated and the connections between the upper covers and the brackets vulnerable to abrasion. Besides, it is relatively difficult to manufacture and assemble the lighter with such structure, which may lead to high rate of unqualified products, and furthermore, if there is any failure in the connection, it would be much difficult to fix it. In addition to such lighters, there is another type of lighter which has its upper cover integrated with the lighter housing. Disadvantages of such structure are that the structure is complicated, the proportion of unqualified products is high due to the application of point-welding process to the connection, and the overall aesthetic effect of the lighter is damaged by possible concave welding spots caused by high temperature welding.

SUMMARY OF THE INVENTION

One objective of the present invention is to provide a lighter with an upper cover to overcome the above defects of the prior art and have simple structure, easy process of assembly and low cost.

In accordance with the present invention, the lighter comprises a lighter housing, a gas container for storing liquid inflammable gas, a combustion device connected to said gas container, and an igniter for igniting inflammable gas in said combustion device, characterized in that said housing includes an upper cover and a case, wherein one side of said upper cover includes a protuberance forming a small hole thereon; a connector disposed below said protuberance of said upper cover for connecting said upper cover and said case, wherein said connector includes a recess portion coupling with said protuberance and having transverse holes on both sides of the recess portion; and a bolt for rotationally connecting said protuberance and the recess portion; wherein said case has at its edge port a longitudinal groove being connected to said connector and having an opening at the edge port of the groove to couple with the protuberance of said upper cover. Furthermore, the connector has a thickness from 1.0 mm to 11 mm.

The lighter with an upper cover according to the present invention is simple in structure and easy in assembly. Since there is provided with a connector, the variation to the structure of the upper cover and the case of the lighter may achieve simple and rational assembly of the case with low cost and simple manufacture.

Wherein: 1—lighter housing; 11—upper cover; 110—protuberance; 111—small hole; 12—case; 121—longitudinal groove; 122—opening; 2—gas container; 3—combustion device; 4—igniter; 5—connector; 51—transverse hole; 52—recess portion; 6—bolt.

DETAILED DESCRIPTION OF THE INVENTION

The present invention now will be described in detail with reference to the embodiments and drawings.

Figure 1:
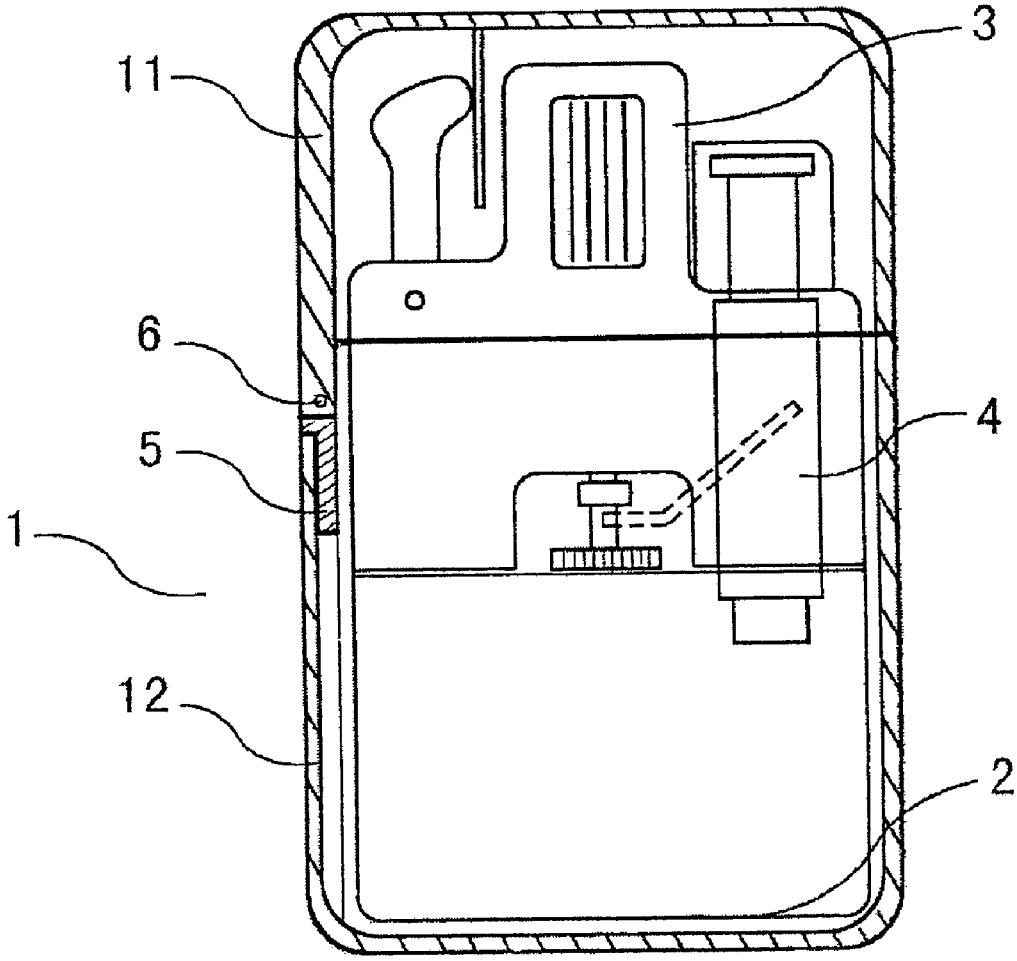
FIG. 1 is a structural sectional view of the present invention.

Refer to FIG. 1, a lighter comprises a lighter housing 1, a gas container 21 for containing liquid inflammable fuel gas, a combustion device 3 connecting to said container 2, and an igniter 4 for igniting inflammable gas in said combustion device 3, wherein said housing 1 includes an upper cover 11 and a case 12. At one side of said upper cover 11 there is a protuberance 110 having a small hole 111 thereon (Refer to FIG. 2).

Figure 2:
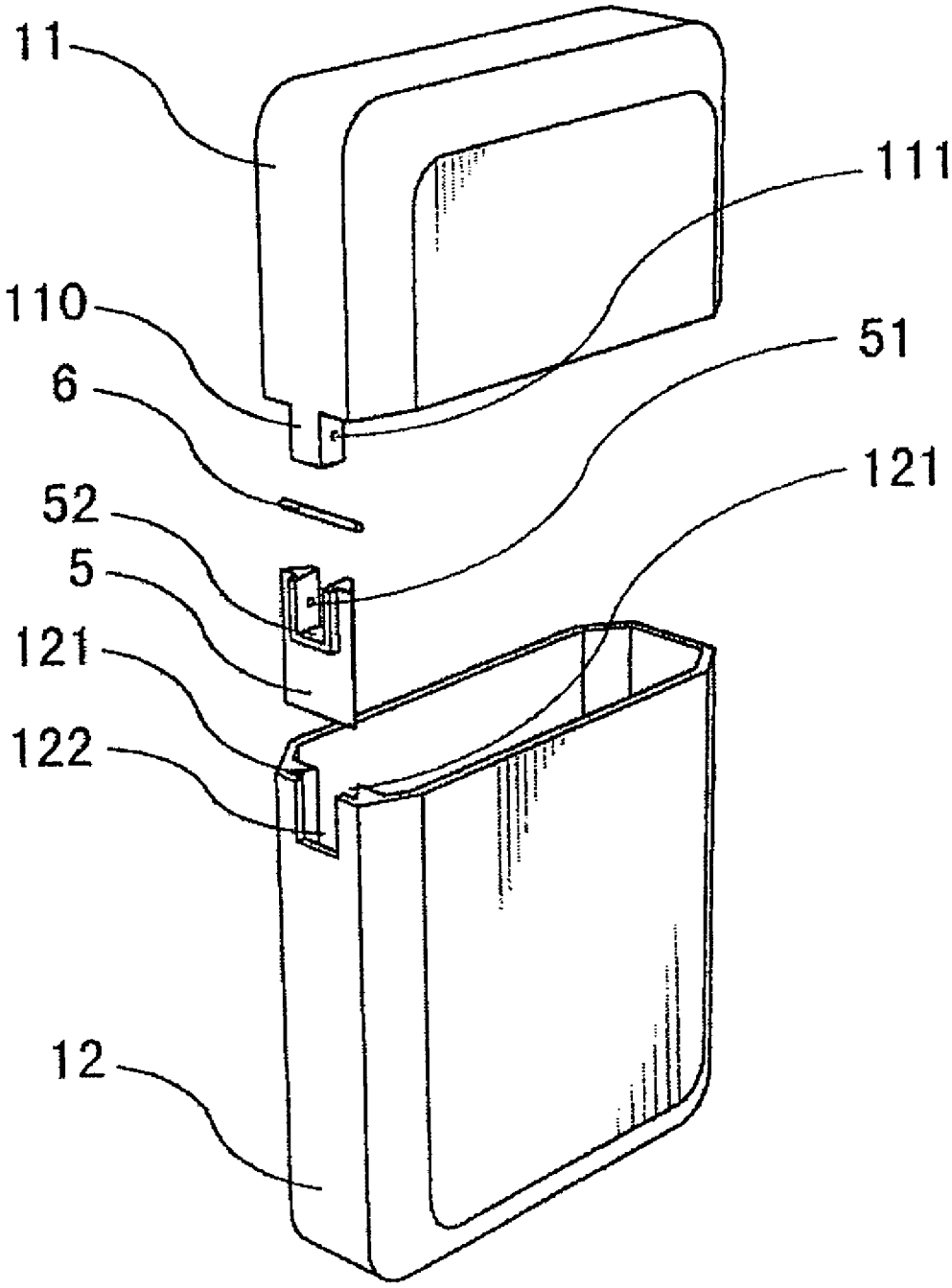
FIG. 2 is a structural sketch of the upper cover, connector and case according to the present invention.
Figure 3:
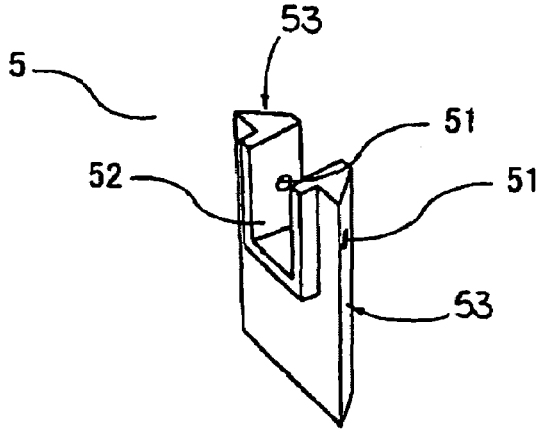
FIG. 3 is a drawing showing enlarged sectional structure of the connector of the present invention.

Refer to FIGS. 2 and 3, there is a connector 5 between said upper cover 11 and said case 12 in the lighter housing. The connector 5 is disposed below the protuberance 110 of the upper cover 11 to connect the upper cover 11 and case 12. The connector 5 includes a recess portion 52 coupling with the protuberance 110 of the upper cover 11 and having transverse holes 51 on both sides of the recess portion 52. A bolt 6 is provided to rotationally connect the protuberance 110 and recess portion 52.

Figure 4:
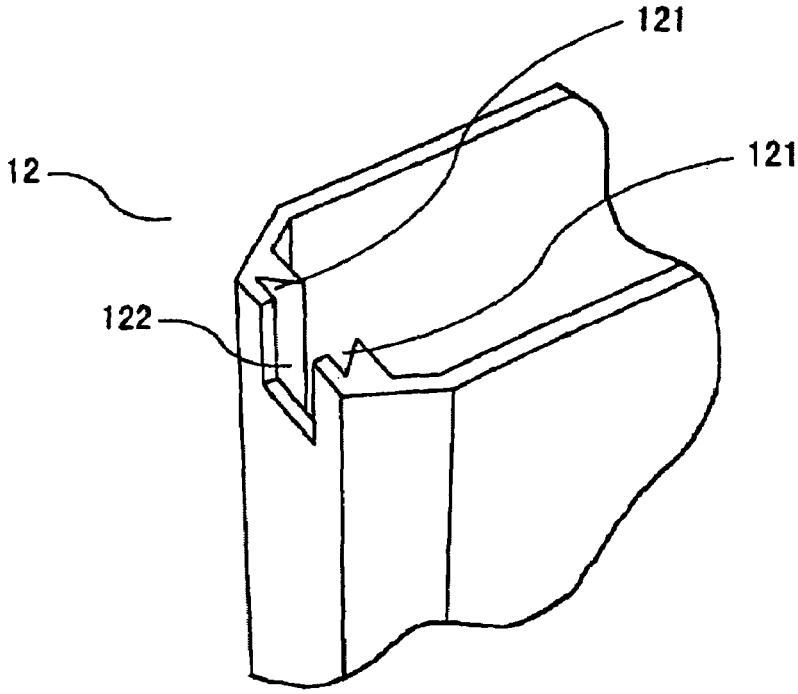
FIG. 4 is a drawing showing enlarged sectional structure of the case of the present invention.

Refer to FIG. 4, there is a longitudinal groove 121 at the edge port of the case 12. The connector 5 is fitted in with and connected to the longitudinal groove 121. The longitudinal groove 121 has at its edge port an opening 122 fitting the protuberance 110 of the upper cover 11 therein.

During the process of assembly, the protuberance 110 is inserted into the recess portion 52, and the bolt 6 passes through the transverse holes 51 and the small hole 111 to connect the connector 5 and the protuberance 110. At the edge of the case 12, there are two longitudinal grooves 121 corresponding to both sides 53 of the connectors 5 (refer to FIG. 4). In this way, the connectors 5 may easily inserted into the longitudinal grooves 121, or further fixed with glue, so as to form a simple integrated lighter housing. In this structure, the upper cover 11 is connected directly to and integrated with the case 12 to eliminate the problem of fitting the upper cover 11 tightly against a core without welding or screw connection and fixation, and thus making the lighter appear a good aesthetic and glossy without any flaw.

The connector has a thickness from 1.0 mm to 11 mm, which facilitate to couple the connector 5 with the upper cover 11 and the case 12. Accordingly, the connector 5 has an inner side and an outer side having a width larger than a width of the inner side to form the two sidewalls of the connector 5 to fit into the two longitudinal grooves 121 respectively. In addition, the thickness of the case side edge of the case 12 is substantially larger than a thickness of the connector 5 such that when the connector 5 is received in the edge port, the connecting device is embedded within the case side edge of the case 12 in a hidden manner.

In order to open or close the upper cover 11 of the housing 1 without hitch, an opening 122 is formed at the edge port of the longitudinal groove 121 of the case 12 so as to moveably connect the protuberance 110 and case 12 when the upper cover 11 fits in the case 12.

Though the present invention has been described in details with reference to the drawings and embodiment, it should be understood by those skilled in the art that the aforementioned embodiments are only for description of the invention and not intended to limit to the present invention. A various of modifications or variations could be made according to the invention and will fall into the protective scope of the present invention.

What is claimed is:

1. A lighter, comprising:

a lighter housing which comprises an upper cover having a protuberance downwardly extended from a cover side edge thereof and a case having a case side edge with a predetermined thickness and an edge port having an opening downwardly extended from an upper edge of said case at said case side edge thereof, wherein said case further has two longitudinal grooves indently formed along two sidewalls of said edge port;

a gas container received in said case of said lighter housing for storing liquid inflammable gas;

a combustion device communicatively connected to said gas container for controlling a flow of said inflammable gas;

means for igniting said inflammable gas in said combustion device; and a connector having an upper recess portion fittingly receiving said protuberance of said upper cover, wherein two sidewalls of said connector are shaped and sized to fittingly engage with said longitudinal grooves respectively, such that said connector is slid into said opening to firmly mount said connector to said case until said upper recess portion of said connector sits on an edge of said opening; and a connecting device which contains a hole transversely formed on said protuberance and two transverse holes formed on said connector at said recess portion thereof to coaxially align with said hole of said protuberance when said protuberance is disposed in said recess portion of said connector, wherein said connecting device further comprises a bolt slidably inserted into said two transverse holes of said connector through said holes of said protuberance to pivotally connect said protuberance of said upper cover with said connector at said recess portion thereof, wherein when said connector is slid into said edge port, said connecting device is hidden within said case side edge of said case at a position below said upper edge of said case so as to pivotally connect said upper cover with said case.

2. The lighter, as recited in claim 1, wherein said thickness of said case side edge of said case is substantially larger than a thickness of said connector such that when said connector is received in said edge port, said connecting device is embedded within said case side edge of said case in a hidden manner.

3. The lighter, as recited in claim 1, wherein said thickness of said connector has a range from 1.0 mm to 11 mm.

4. The lighter, as recited in claim 1, wherein said connector has an inner side and an outer side having a width larger than a width of said inner side to form said two sidewalls of said connector to fit into said two longitudinal grooves respectively.

5. The lighter, as recited in claim 4, wherein said thickness of said case side edge of said case is substantially larger than a thickness of said connector such that when said connector is received in said edge port, said connecting device is embedded within said case side edge of said case in a hidden manner.

6. The lighter, as recited in claim 4, wherein each of said transverse holes is a through hole transversely formed on said connecter at a position close to said outer side thereof.

7. The lighter, as recited in claim 6, wherein said thickness of said connector has a range from 1.0 mm to 11 mm.

8. The lighter, as recited in claim 6, wherein said thickness of said case side edge of said case is substantially larger than a thickness of said connector such that when said connector is received in said edge port, said connecting device is embedded within said case side edge of said case in a hidden manner.

9. The lighter, as recited in claim 8, wherein said thickness of said connector has a range from 1.0 mm to 11 mm.

* * * * *